US005689781A

United States Patent [19]

Shibano et al.

[11] Patent Number: 5,689,781

[45] Date of Patent: Nov. 18, 1997

[54] CARRIER FOR ELECTROSTATIC LATENT IMAGE DEVELOPING

[75] Inventors: Hiroshi Shibano, Takarazuka; Tomoharu Nishikawa, Osaka; Koichi Takenaka, Itami; Hideaki Yasunaga, Sakai, all of Japan

[73] Assignee: Minolta Co., Ltd., Osaka, Japan

[21] Appl. No.: 522,104

[22] Filed: Aug. 31, 1995

[30] Foreign Application Priority Data

Sep. 7, 1994 [JP] Japan ..... 6-213501

[51] Int. Cl.[6] ..... G03G 15/08

[52] U.S. Cl. ..... 399/252; 399/267; 430/105; 430/106.6; 430/108; 430/111

[58] Field of Search ..... 355/245, 251, 355/252, 253; 118/653, 656, 657, 658; 430/105, 106.6, 108, 111, 122; 399/252, 267, 277

[56] References Cited

U.S. PATENT DOCUMENTS

| | | | |
|---|---|---|---|
| 4,284,702 | 8/1981 | Tabuchi et al. | 430/122 |
| 4,600,675 | 7/1986 | Iwasa et al. | 430/106.6 |
| 5,252,398 | 10/1993 | Ohtani et al. | 430/108 X |
| 5,374,978 | 12/1994 | Asanae et al. | 355/245 X |
| 5,472,817 | 12/1995 | Shibano et al. | 430/106.6 |
| 5,483,329 | 1/1996 | Asanae et al. | 355/251 X |
| 5,484,680 | 1/1996 | Goto et al. | 430/122 |
| 5,512,402 | 4/1996 | Okado et al. | 430/106.6 |

*Primary Examiner*—Sandra L. Brase

*Attorney, Agent, or Firm*—Burns, Doane, Swecker & Mathis, LLP

[57] ABSTRACT

A carrier for electrostatic latent image developing for use in methods of developing an electrostatic latent image formed on the surface of a latent image-bearing member by transporting a developer comprising a toner and a carrier via the rotation of a developing sleeve having a built in stationary magnet roller, the carrier for electrostatic latent image developing including magnetic powder dispersed in a binder resin and having a saturation magnetization of about 50 to about 80 emu/g, residual magnetization of about 3 to about 10 emu/g, and coercive force of about 20 to about 50 oersted.

21 Claims, 1 Drawing Sheet

CARRIER FOR ELECTROSTATIC LATENT IMAGE DEVELOPING

BACKGROUND OF THE INVENTION

1. Field of the Invention

The present invention relates to a carrier for use in developers, and more specifically relates to a carrier comprising a magnetic powder dispersed in a binder resin. The carrier may be used in methods of developing an electrostatic latent image formed on the surface of a latent image-bearing member.

2. Description of Related Art

Two-component developers containing a toner and a carrier for use in developing devices are known. Apparatus utilizing such developers may be provided with a developing sleeve formed of a nonmagnetic material and a magnet roller provided within the developing sleeve such that it contains a plurality of magnetic poles. The apparatus is used to perform methods wherein developer is transported via the rotation of both the developing sleeve and the magnetic roller, methods wherein developer is transported via the rotation of the magnet roller alone with a stationary developing sleeve, and methods wherein developer is transported via the rotation of the developing sleeve alone with a stationary magnet roller.

Carriers for developers used in the above-described methods are known to comprise iron particles and ferrite particles having a mean particle size of about 40 to about 200 μm. Such carriers are disadvantageous insofar as they have excessive magnetic force which produces hardening of the magnetic brush, which in turn produces white streaks in solid images. Furthermore, in iron powder carriers the volume resistivity of the carrier itself is low, such that when the density of the toner in the developer is low due to continuous use or the like, the charge on the surface of the electrostatic latent image-bearing member escapes through the carrier. When this occurs, image distortion and defects occur. Further, the carrier adheres to the image area due to injection of the charge from the developing sleeve to the carrier. When hard carriers such as those with iron powder and the like adhere to the electrostatic latent image-bearing member, the surface of the latent image-bearing member is damaged when the residual toner is removed.

U.S. Pat. No. 4,284,702, for example, discloses a binder type carrier wherein a magnetic fine powder is dispersed in a binder resin to eliminate the previously described disadvantages. Carriers of the binder type generally have low magnetization by magnetic field in developing devices compared to iron powder type carriers, and therefore can form a soft magnetic brush which advantageously produces excellent images without carrier-induced white streaks.

In the above processes, a developer is transported in a carrier of a binder type via the rotation of both the developing sleeve and magnet roller. In these processes, non-uniform developing readily occurs due to changes in the magnetic poles in accordance with the rotation of the magnet roller when the magnet roller rotates at low speed. Consequently, the magnet roller must rotate at high speed because this non-uniform developing tends to increase as the developing speed increases. When the rotational speed of the magnet roller increases, an eddy current generated in the developing sleeve increases and causes the developing sleeve to heat and the rotational drive load of the magnet roller to increase.

In order to eliminate the previously described disadvantages, U.S. Pat. No. 4,600,675 discloses the use of a developing method wherein a binder-type carrier is transported via the rotation of the developing sleeve along with the magnet roller stationary. Binder-type carriers generally have low specific gravity and magnetic force compared to iron powder and ferrite carriers. Therefore, the magnetic restraint of the carrier relative to the magnet roller is weak, such that carrier readily adheres to the non-image area of the photosensitive member. However, carrier adhesion can be prevented in this developing method by setting the magnetic characteristics of the binder-type resin within a predetermined range.

To eliminate the previously described disadvantages, increasing the magnetic force (saturation magnetization) of the carrier so as to strengthen the magnetic restraint toward the magnet roller has been considered. However, simply increasing the magnetic force of the carrier reduces flow characteristics of the developer in the developing device, causing developer polarization. That is, in the developing device, carrier flow characteristics are reduced due to the influence of the magnetic force of the respective carrier particles, thereby reducing mixing with the toner and developer flow characteristics. As a result, triboelectric charging of the toner and carrier is inadequate so as to produce insufficiently charged toner, and readily lead to developer flocculation and developer spilling. It further causes image density dispersion in the lengthwise direction of the developing sleeve.

SUMMARY OF THE INVENTION

In view of the previous description, an object of the present invention is to provide a binder-type carrier which does not produce carrier adhesion, and has excellent flow characteristics within the developing device without producing developer polarization or flocculation.

The present invention provides a carrier for electrostatic latent image developing. The carrier is for use in methods of developing an electrostatic latent image formed on the surface of a latent image-bearing member. A developer including a toner and a carrier is transported via the rotation of a developing sleeve having a built in stationary magnet roller. The carrier for electrostatic latent image developing includes a magnetic powder dispersed in a binder resin having a saturation magnetization of about 50 to about 80 emu/g, residual magnetization of about 3 to about 10 emu/g, and coercive force of about 20 to about 50 oersted.

DESCRIPTION OF THE PREFERRED EMBODIMENTS

Figure 1:
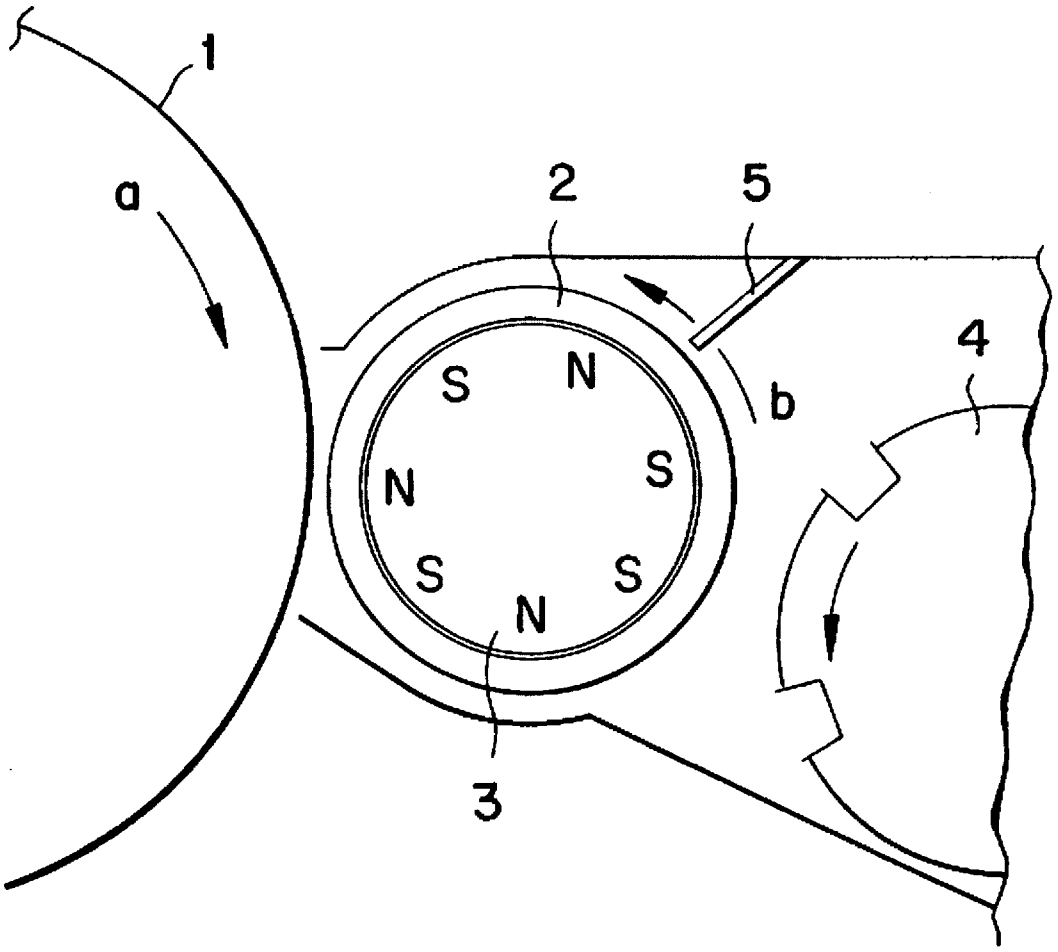
FIG. 1 shows the construction of a developing device using the carrier of the present invention.

The inventors discovered that the problem of reduced developer flow within the developing device produced when carrier saturation magnetization is increased is largely due to carrier residual magnetization. The inventors further discovered that said problem is eliminated by adjusting carrier residual magnetization within a predetermined range.

The carrier of the present invention has a saturation magnetization of about 50 to about 80 emu/g, and preferably about 55 to about 70 emu/g. When the saturation magnetization is less than 50 emu/g, there is inadequate magnetic restraint of the carrier on the magnet roller which readily causes carrier adhesion. When the saturation magnetization exceeds 80 emu/g, the magnetic brush becomes hard so as to cause brush mark irregularities on the image and damage the surface of the photosensitive member. Furthermore, the obtained image has high contrast which reduces halftone reproducibility.

The carrier of the present invention has a residual magnetization of about 3 to about 10 emu/g, and preferably about 3 to about 8 emu/g. When the residual magnetization exceeds 10 emu/g, mixing of the carrier and toner is reduced in the developing device due to the influence of magnetic restraint among carrier particles, such that developer polarization occurs, and developer flow characteristics within the developing device are reduced. When the residual magnetization is less than 3 emu/g, complementation between carrier and toner is reduced, thereby reducing the chargeability of the toner.

The carrier of the present invention has a coercive force of about 20 to about 50 oersted, and preferably about 30 to about 45 oersted. The residual magnetization can be adjusted within the previously mentioned range by maintaining the coercive force within the specified range.

The carrier of the present invention has a mean particle size of about 30 to about 80 μm, and preferably about 40 to about 70 μm. When the coercive force is less than 30 μm, carrier readily adheres to the latent image-bearing member. When the coercive force exceeds 80 μm, the magnetic brush readily causes brush mark irregularities as typically occurs with iron powder carriers and the like, making it difficult to obtain sharp images, and, when used in combination with fine toner particles having a mean particle size of about 3 to about 9 μm, causes the toner to be inadequately charged.

Examples of useful binder resins for the carrier of the present invention include polyester resins, polymethacrylate resins, styrene-acrylic resins, copolymer resins, polyolefin resins, polyester resins, epoxy resins and the like.

It is desirable that the magnetic powder used in the carrier of the present invention has a saturation magnetization of about 60 to about 90 emu/g, residual magnetization of about 1 to about 10 emu/g, and coercive force of about 20 to about 50 oersted. A carrier having the previously described magnetic characteristics can be obtained by using the magnetic powder described above. Magnetite having the magnetic characteristics described above may also be used as the magnetic powder.

The composition may contain about 500 to about 900 parts-by-weight magnetic powder, and preferably about 600 to about 800 parts-by-weight magnetic powder, to 100 parts-by-weight binder resin. A carrier having the previously described specific magnetic characteristics may be obtained by using the above-described percentages of magnetic powder.

A dispersing agent such as carbon black, silica, titania, aluminum and the like may be used in the carrier of the present invention. Inclusion of a dispersing agent improves uniform dispersion of the magnetic powder within the binder resin. The amount of dispersing agent is preferably about 0.01 to about 3 percent-by-weight relative to the carrier.

The carrier of the present invention may be manufactured by a kneading pulverization method wherein binder resin and magnetic powder in a predetermined mixture is heated and kneaded, then cooled, pulverized and classified. The carrier may also be manufactured by a spray dry method wherein the binder resin is dissolved in a solvent and magnetic powder is dispersed in the resultant resin solution, after which the material is spray dried.

When the carrier of the present invention is manufactured by a kneading pulverization method, it may also be heat processed after classification. Heat processing is preferably an instantaneous process wherein the carrier is blown out in an airflow. For example, a suffusing system (Japan Unimatic, Ltd.) may be used as such a heat processing device, with the heating temperature being about 150° to about 400° C. When such a heating process is used, the surface shape of the carrier can be reformed, such that a carrier is obtained having excellent wear resistance without loss of magnetic powder after repeated use.

The toner used in combination with the carrier of the present invention may be a well-known toner having a mean particle size of about 2 to about 20 μm, or a fine toner having mean particle size of about 4 to about 9 μm when highly detailed images are reproduced. Although a reduction in flow characteristics occurs in fine toners having a mean particle size of about 4 to about 9 μm, such toner is suitable for use in combination with the carrier of the present invention.

The carrier of the present invention is suitable for use in developing methods wherein a magnet roller is stationary and the developing sleeve is rotated. An example of such a developing method is shown in FIG. 1.

The developing device of FIG. 1 is provided with developing sleeve 2 arranged at a position opposite photosensitive drum 1 which is rotatable in the arrow a direction, magnet roller 3 arranged so as to be stationary within the developing sleeve, and bucket roller 4 which mixes a developer comprising a toner and a carrier and supplies said developer to the developing sleeve. Developing sleeve 2 is cylindrical in shape and formed of a non-magnetic conductive material such as aluminum or the like, and is provided at a position opposite photosensitive drum 1 with a small space disposed therebetween and is rotatable in the arrow b direction. Magnet roller 3 is provided with a plurality of magnetic poles along its circumference; homopolar magnetic sections are provided on the downstream side from the area opposite photosensitive drum 1 in the direction of rotation of developing sleeve 2, and on the upstream side from the area opposite brush-height regulating blade 5 in the direction of rotation of developing sleeve 2.

Developer supplied from bucket roller 4 to the surface of developing roller 2 forms a magnetic brush via the action of the magnetic force of magnet roller 3, and is transported via the rotation of developing roller 2 in the arrow b direction. After the height of the magnetic brush is regulated by brush-height regulating blade 5, it is transported to the developing region and develops an electrostatic latent image formed on the surface of photosensitive drum 1 via a developing bias from a direct current (DC) power source not shown in the illustration. After development ends, the residual developer remaining on the surface of developing sleeve 2 (i.e., carrier and toner not used for developing) is transported to the homopolar magnetic section of magnet roller 3 via the rotation of developing sleeve 2, removed from developing sleeve 2 via the action of the magnetic force of the homopolar magnetic section, and mixed with the developer accommodated in the developing device via bucket roller 4.

The carrier of the present invention has excellent flow characteristics within the developing device and does not produce carrier adhesion to the non-image area on the surface of photosensitive drum 1 during developing. Further, it provides excellent mixing with the toner and thus avoids developer polarization and flocculation, and allows the uniformly mixed developer to be supplied to developing sleeve 2.

In the developing device of FIG. 1, the means for supplying developer to developing sleeve 2 is not limited to the use of the previously mentioned bucket roller, and may be, for example, a screw or the like which mixes the developer and supplies said developer to developing sleeve 2. Furthermore, the developing bias is not limited to a DC bias, and may be, for example, an overlay of a DC bias and an AC (alternating current) bias.

A developing device preferred for use in combination with the carrier of the present invention provides a magnet roller having a magnetic force of about 700 to about 1500 gauss, and preferably about 800 to about 1300 gauss, in the developing region. The magnetic poles in the developing region may be a single pole or a plurality of homopolar magnetic poles. The rotational speed of the developing sleeve is $1 \leqq \theta \leqq 2$, and preferably $1.5 \leqq \theta \leqq 2$, where $\theta$ is (sleeve circumferential speed/drum circumferential speed).

The carrier or developer of the present invention is most effective when used in combination with the developing device.

Specific examples of the present invention are described hereinafter, but the present invention is not limited to the following examples.

EXAMPLE 1

One hundred parts-by-weight (hereinafter referred to as "pbw") polyester resin (NE-1110; Kao Ltd.), 700 pbw magnetite powder (saturation magnetization 65.3 emu/g, residual magnetization 3.2 emu/g, coercive force 37.0 oersted, oil absorption 13.1 g/100 g), 2 pbw carbon black (EC; Lion Co., Ltd.), and 1.5 pbw silica (#200) were thoroughly mixed using a Henschel mixer, and fusion kneaded with a pressure kneader. The kneaded material was cooled, coarsely pulverized in a feather mill, then finely pulverized using a jet mill (type IDS-II). Subsequently, the pulverized material was classified by multiplex, and subjected to heat processing at 300° C. using a suffusion system (SFS-1; Japan Unimatic) to obtain carrier 1 having a mean particle size of 50 μm, saturation magnetization of 59.5 emu/g, residual magnetization of 5.0 emu/g, coercive force of 37.0 oersted, and electrical resistance of $6.3 \times 10^{12}$ Ω·cm.

Measurement of carrier mean particle size was accomplished using a Coulter counter model TA-II (Coulter Counter Co.). Particle size relative weight distribution was measured with an aperture of 280 μm.

Carrier saturation magnetization and residual magnetization were measured using a DC magnetization characteristic automatic recording device (type 3257; Yokogawa-Hokushin Electric Works, Ltd.).

COMPARATIVE EXAMPLE 1

Carrier 2 was produced in the same manner as carrier 1 with the exception that 250 pbw magnetite powder was added to obtain particles having a mean particle size of 50 μm, saturation magnetization of 48.6 emu/g, residual magnetization of 4.1 emu/g, coercive force of 37.0 oersted, and electrical resistance of $13.5 \times 10^{12}$ Ω·cm.

COMPARATIVE EXAMPLE 2

Carrier 3 was produced in the same manner as carrier 1 with the exception that 700 pbw ferrite powder (MFP-2; TDK, Ltd.; saturation magnetization 66.3 emu/g, residual magnetization 19.4 emu/g, coercive force 156.9 oersted, oil absorption 25.2 g/100 g) was added to obtain particles having a mean particle size of 50 μm, saturation magnetization of 58.8 emu/g, residual magnetization of 14.8 emu/g, coercive force of 156.9 oersted, and electrical resistance of $2.1 \times 10^{12}$ Ω·cm.

COMPARATIVE EXAMPLE 3

Carrier 4 was produced in the same manner as carrier 1 with the exception that 250 pbw ferrite powder was added to obtain particles having a mean particle size of 50 μm, saturation magnetization of 0.48.0 emu/g, residual magnetization of 12.1 emu/g, coercive force of 156.9 oersted, and electrical resistance of $9.8 \times 10^{12}$ Ω·cm.

EXAMPLE 2

Carrier 5 was produced in the same manner as carrier 1 with the exception that 500 pbw magnetite powder (saturation magnetization 70.2 emu/g, residual magnetization 8.5 emu/g, coercive force 40.1 oersted, oil absorption 14.2 g/100 g) was added to obtain particles having a mean particle size of 50 μm, saturation magnetization of 60.2 emu/g, residual magnetization of 7.1 emu/g, coercive force of 40.1 oersted, and electrical resistance of $7.9 \times 10^{12}$ Ω·cm.

EXAMPLE 3

Carrier 6 was produced in the same manner as carrier 1 with the exception that 800 pbw magnetite powder (saturation magnetization 72.7 emu/g, residual magnetization 4.3 emu/g, coercive force 35.6 oersted, oil absorption 10.3 g/100 g) was added to obtain particles having a mean particle size of 50 μm, saturation magnetization of 64.2 emu/g, residual magnetization of 3.6 emu/g, coercive force of 35.6 oersted, and electrical resistance of $1.9 \times 10^{12}$ Ω·cm.

Toner Adjustment

One hundred parts-by-weight styrene-n-butylmethacrylate resin (softening point 132° C., glass transition point 60° C.), 8 pbw carbon black (MA#8, Mitsubishi Chemical Co., Ltd.), and 5 pbw nigrosine dye (ponttone N-01; Oriental Chemical Co.) were thoroughly mixed in a ball mill, heated to 140° C., and kneaded with three rollers. After the kneaded material was cooled, it was coarsely pulverized, then finely pulverized using a jet mill. The resultant material was then classified by forced air to obtain toner particles having a mean particle size of 8 μm.

To 100 pbw of the aforesaid toner particles was added 0.1 pbw colloidal silica (R974) to obtain a positive-charge toner.

Evaluation

Toner obtained by toner adjustment and carriers 1–6 were mixed so as to produce an adjusted developer having a toner mix ratio of 8%. Each developer was evaluated after 5,000 copies using a model EP-5400 copying machine (Minolta Co.) in which was installed a developing device having a stationary magnet roller and rotating developing sleeve. Results of evaluation of carrier development of the obtained images, evaluation of developer polarization in the developing device after 5,000 copies, and evaluation of the occurrence of flocculation in the developer in the developing device after 5,000 copies are shown in Table 1.

In Table 1, carrier development was visually evaluated by inspecting carrier development of non-image areas of the obtained images; the absence of carrier development was indicated by O, some carrier development which did not pose a problem in terms of practical application was indicated by Δ, and carrier development producing image noise was indicated by X.

Developer polarization was evaluated by measuring image density at points 20 cm from the solid image in a direction perpendicular to the sheet transport direction after 5,000 copies using a markbase reflection densitometer model RD20S, and measuring the difference in image density in the lengthwise direction of the developing device caused by developer polarization. Values less than 0.05 are indicated by O, values of 0.05 and greater but less than 0.1 are indicated by Δ, and values of 0.1 and greater are indicated by X. The evaluation results are shown in Table 1.

Evaluation of flocculent in the developer was accomplished visually by filtering the developer after 5,000 copies through a 90 μm filter, and examining for flocculent residue on the filter. No flocculent present was indicated by O, whereas the presence of flocculent was indicated by X.

TABLE 1

Evaluation of Developer Properties of Carriers 1–6

| | Carrier | Saturation magnetization (emug/) | Residual magnetization (emu/g) | Coercive force (oersted) | Carrier development | Developer polarization | Flocculent |
|---|---|---|---|---|---|---|---|
| Ex. 1 | 1 | 59.5 | 5.0 | 37.0 | O | O | O |
| Ref Ex 1 | 2 | 48.6 | 4.1 | 37.0 | X | O | O |
| Ref Ex 2 | 3 | 58.8 | 14.8 | 156.9 | O | X | X |
| Ref Ex 3 | 4 | 48.0 | 12.1 | 156.9 | X | X | X |
| Ex. 2 | 5 | 60.2 | 7.1 | 40.1 | O | O | Δ |
| Ex. 3 | 6 | 64.2 | 3.6 | 35.6 | Δ | O | Δ |

The present invention provides a binder type carrier which does not produce carrier adhesion, or developer polarization or flocculation in the developing device even when used in developing methods employing a stationary magnet roller and rotating developing sleeve.

What is claimed is:

1. A method for forming a magnetic brush comprising:
forming an electrostatic latent image;
rotating a sleeve which is adjacent to the image;
arranging a fixed magnet adjacent to the sleeve; and
applying a developer including a toner and a carrier onto said sleeve, said carrier having a saturation magnetization of about 50 to about 80 emu/g, a residual magnetization of about 3 to about 10 emu/g, and a coercive force of about 20 to about 50 oersted, said carrier comprising a binder resin and magnetic powder dispersed in the binder resin.

2. The method for forming a magnetic brush as in claim 1 wherein the residual magnetization is from about 3 to about 8 emu/g, and the coercive force is from about 30 to about 45 oersted.

3. The method for forming a magnetic brush as in claim 1 wherein the toner has a mean particle size of about 2 to about 20 microns and the carrier has a mean particle size of about 30 to about 80 microns.

4. The method for forming a magnetic brush as in claim 1 wherein the magnetic powder has a saturation magnetization of about 60 to about 90 emu/g, a residual magnetization of about 1 to about 10 emu/g, and a coercive force of about 20 to about 50 oersted.

5. The method for forming a magnetic brush as in claim 1 wherein the magnetic powder is about 500 to about 950 parts-by-weight to 100 parts-by-weight of the binder resin.

6. The method for forming a magnetic brush as in claim 1 wherein the carrier includes a dispersing agent selected from the group consisting of carbon black, silica, titania and aluminum.

7. The method for forming a magnetic brush as in claim 6 wherein the dispersing agent is present in an amount from about 0.01 to about 3 percent-by-weight.

8. The method for forming a magnetic brush as in claim 1 wherein the carrier has a surface which is treated by heating.

9. The method for forming a magnetic brush as in claim 1 wherein the fixed magnet has a magnetic force of about 700 to about 1500 gauss.

10. The method for forming a magnetic brush as in claim 1 wherein the fixed magnet has a magnetic force of about 800 to about 1300 gauss.

11. The method for forming a magnetic brush as in claim 1 wherein a relative speed ratio of the sleeve to the electrostatic latent image is defined by the following formula;

$$1 \leq \theta \leq 2$$

wherein θ is the relative speed ratio.

12. A method for forming a magnetic brush comprising:
forming an electrostatic latent image;
rotating a sleeve which is adjacent to the image;
arranging a fixed magnet adjacent to the sleeve; and
applying a developer including a toner and a carrier onto said sleeve, said carrier having a saturation magnetization of about 50 to about 80 emu/g, a residual magnetization of about 3 to about 10 emu/g, and a coercive force of about 20 to about 50 oersted, wherein said carrier comprises a binder resin and magnetic powder dispersed in the binder resin and the magnetic powder has an oil absorption of about 5 to about 15 g/100 g.

13. A carrier comprising:
a binder resin; and
magnetic powder dispersed in the binder resin, said carrier having a saturation magnetization of about 50 to about 80 emu/g, a residual magnetization of about 3 to about 10 emu/g, and a coercive force of about 20 to about 50 oersted.

14. The carrier of claim 13, wherein the residual magnetization is from about 3 to about 8 emu/g and the coercive force is from about 30 to about 45 oersted.

15. The carrier of claim 13, wherein the toner has a mean particle size of about 2 to about 20 microns and the carrier has a mean particles size of about 30 to about 80 microns.

16. The carrier of claim 13, wherein the magnetic powder has a saturation magnetization of about 60 to about 90 emu/g, a residual magnetization of about 1 to about 10 emu/g and a coercive force of about 20 to about 50 oersted.

17. The carrier of claim 13, wherein the magnetic powder is about 500 to about 950 parts by weight to 100 parts by weight of the binder resin.

18. The carrier of claim 13 further includes a dispersing agent selected from the group consisting of carbon black, silica, titania and aluminum.

19. The carrier of claim 18, wherein the dispersing agent is present in amount from about 0.01 to about 3 percent-by-weight.

20. The carrier of claim 13, wherein the surface of the carrier is treated by heating.

21. A carrier comprising:

a binder resin; and magnetic powder dispersed in the binder resin, said carrier having a saturation magnetization of about 50 to about 80 emu/g, a residual magnetization of about 3 to about 10 emu/g, and a coercive force of about 20 to about 50 oersted, said magnetic powder having an oil absorption of about 5 to about 15 g/100 g.

* * * * *